US005646667A

United States Patent [19]

Broder et al.

[11] Patent Number: 5,646,667

[45] Date of Patent: Jul. 8, 1997

[54] COMBINED CENTRAL AND LATERAL HOLD-DOWN PLATES, AND END-OF-PAGE ADVANCE-DISTANCE DECREASE, IN LIQUID-INK PRINTERS

[75] Inventors: Damon W. Broder; William C. Hilliard, both of San Diego; Aneesa Rahman Scandalis, Escondido; Gerold G. Firl, Poway; Robert R. Giles, Escondido; Joseph P. Milkovits, San Diego, all of Calif.

[73] Assignee: Hewlett-Packard Company, Palo Alto, Calif.

[21] Appl. No.: 417,510

[22] Filed: Apr. 4, 1995

Related U.S. Application Data

[63] Continuation of Ser. No. 57,364, Apr. 30, 1993, abandoned.

[51] Int. Cl.[6] ..... B41J 2/01; B41J 13/14

[52] U.S. Cl. ..... 347/104; 400/645

[58] Field of Search ..... 347/104, 16; 400/645, 400/642

[56] References Cited

U.S. PATENT DOCUMENTS

| | | | |
|---|---|---|---|
| 4,603,987 | 8/1986 | Koranishi | 400/639.1 |
| 4,992,805 | 2/1991 | Yoshizawa | 347/104 |
| 5,015,109 | 5/1991 | Brandon | 400/642 X |
| 5,065,169 | 11/1991 | Vincent | 347/8 |
| 5,102,247 | 4/1992 | Magoshi | 400/642 |

*Primary Examiner*—Joseph W. Hartary

[57] ABSTRACT

Two printing-medium guide systems restrain the medium. One is in an area upstream (along the direction of medium advance) from the pen, and extending laterally across the width of the medium except in one or more regions laterally near the engagement of a print-medium advancing device. The other guide system is disposed laterally from the pen, and extends laterally across the medium only in one or more regions laterally near the engagement of the advancing device. Preferably these "one or more regions" are only near the lateral edges of the medium—so that (1) the first guide system restrains the medium over an area that stops short (ideally about 1½ centimeter short) of the lateral edges; and (2) the second guide system is bifurcated, disposed laterally in two directions from the pen, and restrains the medium across only the lateral edges of the medium (most preferably in a strip whose width is a few millimeters, ideally 3 mm). Preferably a human-actuable control selects a print-medium width, and shifts at least one bifurcation of the second guide system. A tensioning system, longitudinally beyond the marking head from the medium advancing device, and generally aligned laterally with that device, tensions the medium away from the advancing device to hold the medium taut at the pen. Preferably the advancing and tensioning devices are very closely spaced upstream and downstream, respectively, from the pen zone. When tensioned, the medium moves a normal distance through the apparatus at each operation of the advancing device; but after a trailing edge of the medium passes the advancing device (so that the medium is advanced only by the tensioner and no longer tensioned), the advance distance is decreased (preferably by about half).

14 Claims, 4 Drawing Sheets

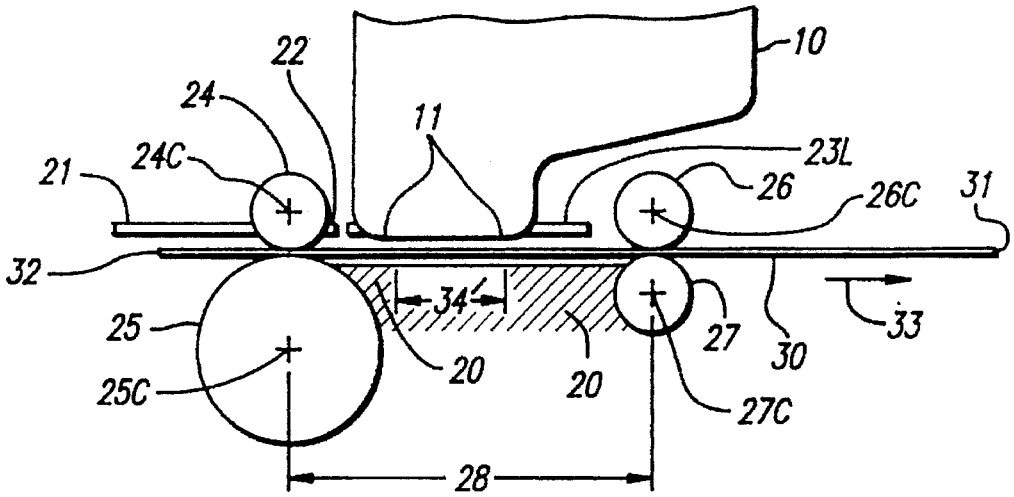
FIG. 1
FIG. 2
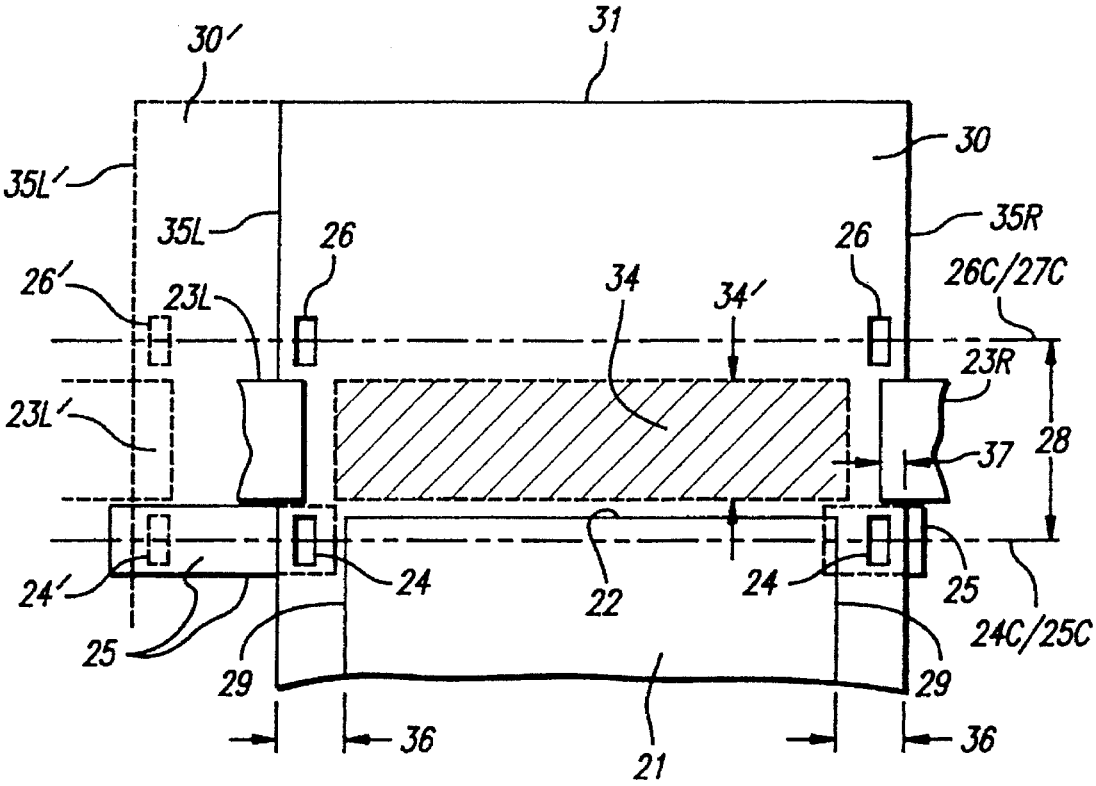

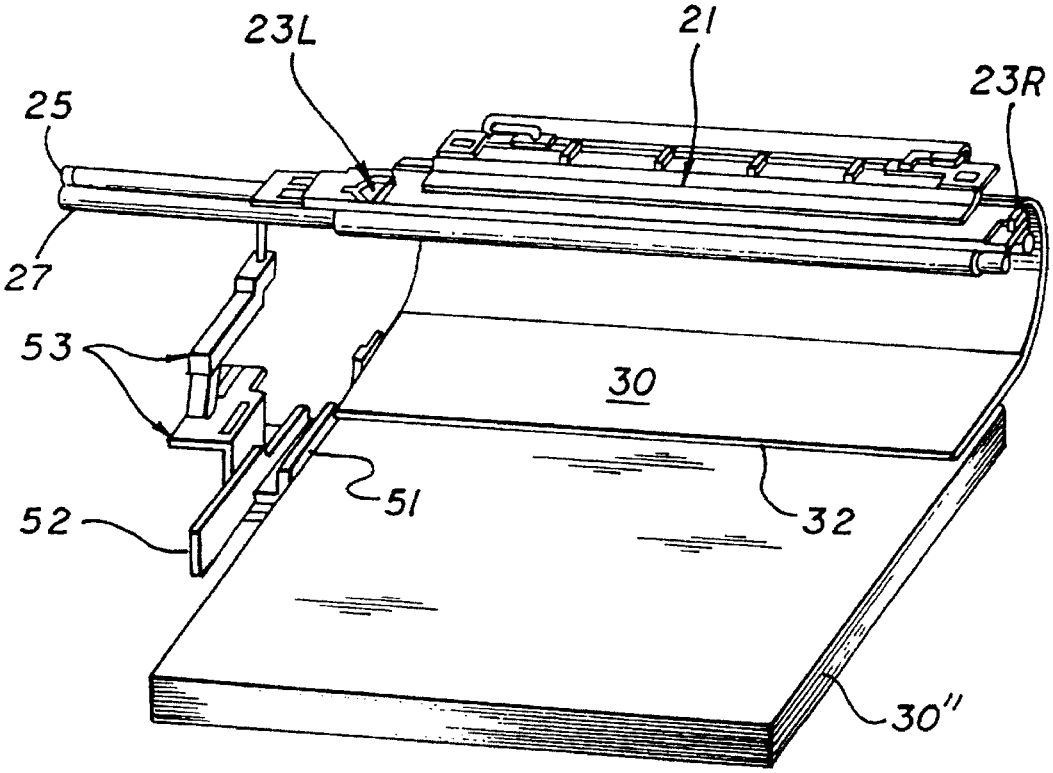
FIG. 3
FIG. 6
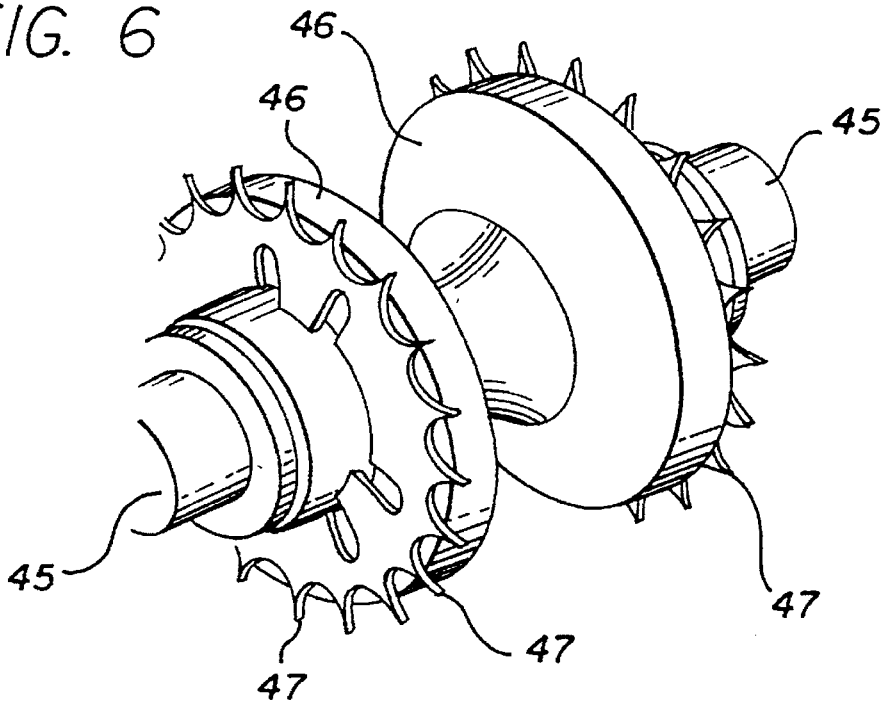

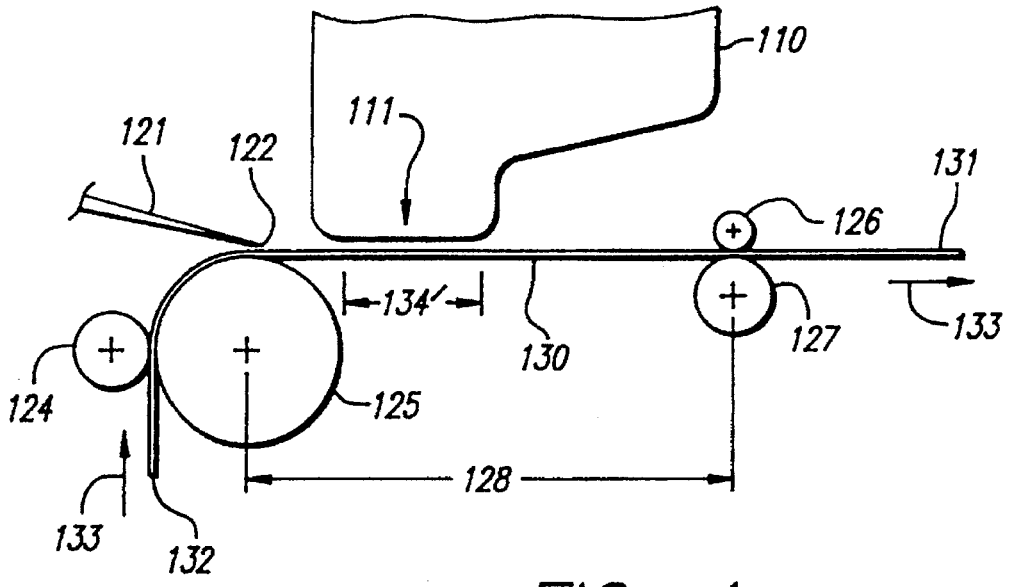
FIG. 4 PRIOR ART
FIG. 5 PRIOR ART
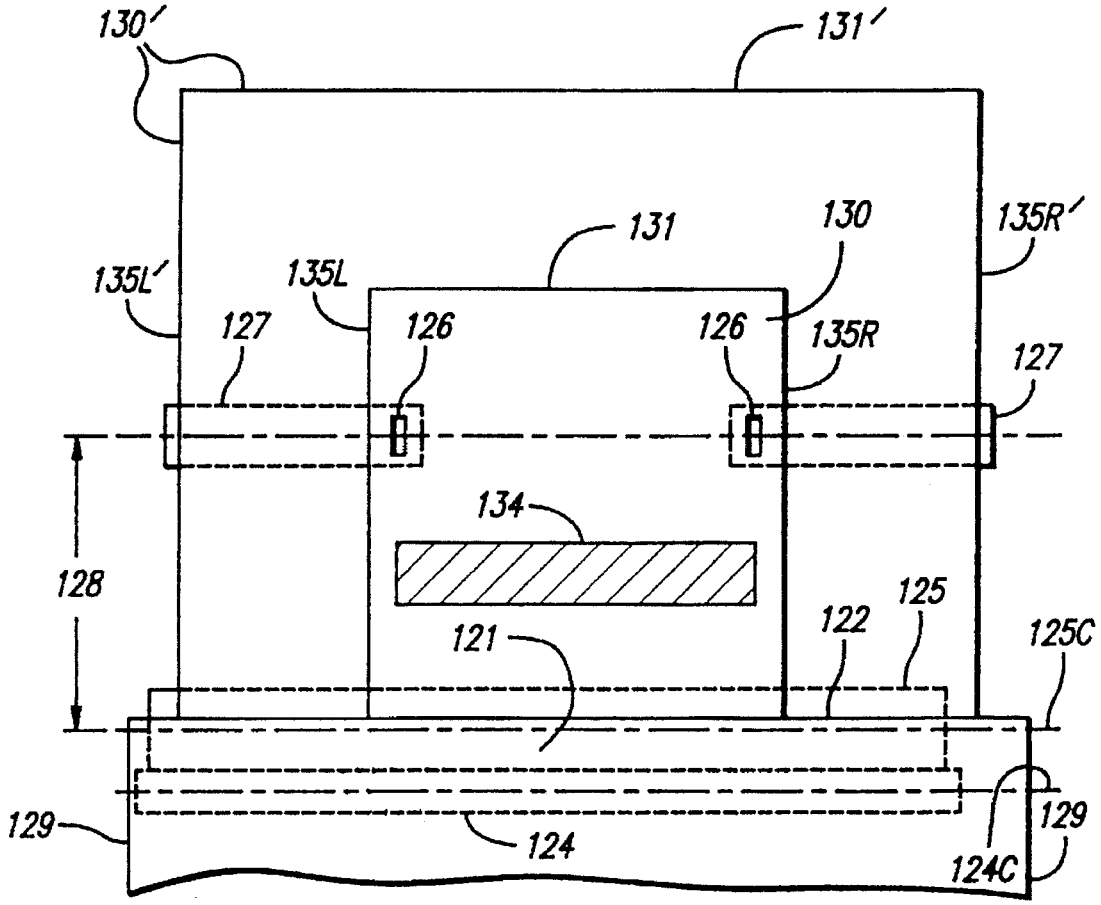

COMBINED CENTRAL AND LATERAL HOLD-DOWN PLATES, AND END-OF-PAGE ADVANCE-DISTANCE DECREASE, IN LIQUID-INK PRINTERS

This is a continuation of application Ser. No. 08/057,364, filed on Apr. 30, 1993, now abandoned.

BACKGROUND

1. Field of the Invention

This invention relates generally to machines and procedures for printing text or graphics on printing media such as paper, transparency stock, and other glossy media; and more particularly to apparatus and methods that construct text or images from individual marks created on the printing medium, in a two-dimensional pixel array, by a pen or other marking element or head that scans across the medium.

The invention is particularly beneficial in printers that operate by the thermal-inkjet process—which discharges individual ink drops onto the printing medium. As will be seen, however, certain features of the invention are applicable to other scanning-head printing processes as well.

2. Prior Art

U.S. Pat. No. 5,065,169, of Vincent et al., introduces the importance of controlling pen-to-printing-medium distance, and flatness of the medium, in an inkjet printer. The entire disclosure of that patent is hereby incorporated by reference into this document. Vincent discloses one way of performing those functions by means of a spacer formed as a skid, roller or the like that travels with the pen.

That system performs well and is very useful—particularly in the context of a printer that has a single pen. In a multiple-pen printer, however, to facilitate simultaneous printing the pens advantageously are staggered along the direction of printing-medium advance; in such a situation a skid or roller closely associated with each of one or more trailing (downstream) pens would likely smear the ink deposited by one or more leading pens.

Under some circumstances the patented system might possibly serve even for a dual-pen printer if the skid on the trailing pen were spaced adequately behind the pen, as the skid might still be able to control the pen-to-medium distance adequately at a slightly greater distance from the pen. Due to accumulated stagger distance, this solution would be significantly less satisfactory for a four-pen printer such as is typically employed for color-plus-black inkjet printing.

Even in such cases the patented system might conceivably serve if the printing medium were limited to paper, for ink might be absorbed by the paper quickly enough to permit sliding or rolling of the spacer device over a printed area without smearing the deposited ink. In particular such a system might be rendered adequate with evaporative drying enhanced through aids such as a heater or fan, or slow throughput (printed area per unit time) to extend drying time, or combinations of these provisions.

Modern color-plus-black printers, however, are called upon to print transparencies and also to print on other glossy printing media—and to perform these feats at high speed. These plastic printing surfaces are much less absorbent than paper and typically require a heater or fan, as well as special printing modes, just to obtain adequate drying speed and throughput—without regard to stabilizing ink-drop flight distance or flattening the medium.

In fact use of a heater has become commercially important to hasten drying and has in turn introduced still other problems. In a heated print zone, changes in the temperature and humidity of a printing medium cause the medium (especially paper) to deform—both in and out of the plane of the medium. The problem addressed here is that out-of-plane deformation can cause either a decrease in print quality or collision of a leading edge of the medium with part of the mechanism—e.g., a so-called "paper crash" or "paper jam".

Failures of the printing medium to pass smoothly through the apparatus can manifest themselves in tearing or folding of the medium, or in smearing of the printed image. Whatever the form, such failures are very costly in terms of wasted material and time, and also in operator frustration; and therefore strongly affect the acceptability of a printing machine.

Hence other solutions have been sought. FIGS. 4 and 5 illustrate a representative paper-guide or hold-down-plate arrangement that has been employed in one printer available commercially from the Hewlett Packard Company as that firm's Model XL300 PaintJet®.

As can be seen, the arrangement provides a single hold-down plate 121 that extends completely across and beyond the entire width of the largest size of printing medium 130' accepted by the unit—thus covering and controlling not only a relatively small or narrow sheet 130 but also a relatively large or wide sheet 130'. In the system under discussion the downstream or output edge 122 of the hold-down plate 121 is nearly tangent to the top of the drive roller 125, and spaced just slightly above the roller surface.

The plate 121 is upstream (along the direction 133 of paper advance) from a preferably heated print zone 134—which is the operating region of the nozzles 111 of one or more pens 110—or in other words along the input side of that zone 134. (To keep the diagrams simple and therefore clear, only one pen 110 is shown; but ordinarily in such systems three color-ink pens and one black-ink pen are present, and the single pen in the diagrams is to be understood as representative of all four.) A pinch roller 124 in turn is upstream from the plate, but positioned partway down around the drive roller 125, to hold the printing medium 130 in tight contact with the drive roller 125.

The drive roller 125 is about forty-five millimeters in diameter, and the pinch roller 124 about twelve. To avoid smearing ink deposited in the print zone 134, and also to avoid interference with one or more tension rollers 127 and particularly one or more mating star wheels 126, no plate is provided on the downstream—or output—side of the print zone 134.

(FIG. 6 shows what is meant by a "star wheel": the hub 45 and rollers 46 are molded together from a material commercially known as "Acetal®", which is twenty-percent Teflon®; and the sharp traction gears or "stars" are of fully hardened industrial-specification 302 stainless steel. The specific configuration illustrated is not prior art, but rather is a preferred form for use in the present invention.)

The hold-down plate 121 holds the medium 130 or 130' flat, immediately adjacent to the print zone 134; that is to say, the pen or pens 110 print close to the plate 121 but not on it. By holding the medium 130, 130' flat, the plate 121 generally deters paper jams and enhances print quality.

Through extensive observation and experiment, however, it has been found that the plate 121 does not prevent paper jams and optimize print quality consistently. Sometimes the lateral edges 135L, 135R (or 135L', 135R') of the page 130 (130') curl upward; this deformation requires raising the carriage (not shown) and pens 110, to avoid collision— which in turn lowers print quality by causing uncertainty in time of flight (as explained in the Vincent patent) and by causing spray.

Also addressed to the problems of print-medium deformation is another part of the system illustrated in FIGS. 4 and 5. The tension roller or rollers 127 and star wheels 126 disposed at the output or downstream side of the print zone 134.

The tension roller 127 and star wheel 126 are centered a distance 128 of some 4½ centimeters from the drive-roller 125 centerline 125C. They are also about that same distance from the downstream edge 122 of the hold-down plate 121.

The tension roller 127 is typically about nineteen millimeters in diameter, and the star wheel 126 about six. The tension roller 127 and star wheel 126 constrain the medium 130 (or 130') in two ways.

First, the star wheels 126 constrain the medium 130, 130' vertically against the tension roller 127. Secondly, in the region between the two pairs of rollers 124/125, 126/127 the tension roller 127 and star wheel 126 hold the medium 130 taut and therefore relatively flat.

To accentuate this second effect, the tension roller can be overdriven. This means that the tension roller 127 and thereby the star wheel 126 are driven at a slightly greater rate than the drive roller 125, but with a clutch arrangement or the like to allow for slippage.

This part of the system too, unfortunately, is not always entirely adequate in constraining the medium enough to prevent a jam. In fact through observation and experiment it has been found that the leading edge 131 or 131' of the medium sometimes strikes one or the other star wheel 126 too high.

More specifically, the medium sometimes strikes a star wheel 126 above the point on the wheel at which that wheel can capture the edge 131, 131' and channel it properly downward against the tension roller 127. The result is a paper crash or jam—spoiling the sheet 130, 130' of printing medium, interfering with operation, and usually requiring operator intervention to clear the mechanism and reinitiate proper passage of a fresh sheet through the printer.

Printing machines of the type under discussion are also subject to a related problem. When the trailing edge 132 of the printing medium passes the pinch roller 124, the medium is no longer taut and is driven solely by the downstream tension roller 127 and star wheel 126.

With careful mechanical design, the effects of the absence of tautness as such can be rendered unimportant; but curiously the fact that the tension roller 127 has become the only driver has a significant adverse consequence. If the tension roller 127 is relatively small in diameter—as compared for example with the drive roller 125—then the relative accuracy of the printing-medium advance by the tension roller is necessarily poor.

In operation of this type of printing machine, periodically the printing-medium advance mechanism 124–127 is actuated to advance the medium stepwise—by some normal distance 41 (FIG. 7) at each step. This typically occurs between repetitions of scanning the print head 110 across the printing medium 130.

Accordingly, on the one hand, with a small tension roller, the amount of printing-medium advance cannot be controlled accurately in the end-of-page region after the drive roller can no longer engage the sheet. A result is significant mutual misalignment of successive printed swaths resulting from successive print-head scans.

The mutually misaligned swath borders appear conspicuously, making each swath stand out visually as a separate printed strip or band rather than blending smoothly into a single image. This undesirable effect accordingly is called "banding".

Banding is noticeable in large part because the positioning error accumulates or accrues over a significant distance of paper advance. That distance (in a three-pass system with a pen having ninety-six nozzles, and approximately twelve nozzles per millimeter) is the height 41 of one-third of a swath, or typically thirty-two pixel rows—equalling roughly 2½ millimeters (one-tenth inch).

If, on the other hand, the tension roller is instead made relatively large in diameter, then the starwheel/tension-roller contact area is forced further from the print zone, diminishing control over the printing medium in that zone. What is desired is both accurate advance and good control of the medium.

The end-of-page region under consideration here has a height 140 (FIG. 7) corresponding approximately to the distance 128 (FIGS. 4 and 5)—measured along the printing-medium 130 path—between the contact areas of the two roller pairs 124/125, 126/127. As can be seen from FIG. 5, this distance substantially equals the direct center-to-center distance 128 between the drive and tension rollers 125, 127, plus roughly a quarter the circumference of the drive roller 125.

The total, based on dimensions recited earlier, is roughly nine centimeters (3½ inches). Accordingly, in the prior-art system illustrated, the banding effect is not only significant in magnitude and therefore quite noticeable, but also extended over a distance 140 (FIG. 7) which is a rather large fraction of the height of each sheet.

Some leading-edge and trailing-edge problems of printing-medium control are sometimes addressed by inhibiting printout near the leading and trailing (top and bottom) edges of each sheet. The necessity for heating the medium in those areas is thereby obviated, reducing curl etc.

This technique can reduce the likelihood of unrestrained corners being in the print zone and so minimize the likelihood of crashes. Unfortunately, however, as will be appreciated this technique produces unacceptably large top and bottom margins.

In summary, prior systems are sometimes subject to paper crashes particularly near the leading edge of each sheet, degraded image quality due to curling and other flight-time-related errors particularly along the lateral edges over the full height of each sheet, and banding near the trailing edge. As can now be seen, important aspects of the technology which is used in the field of the invention are amenable to useful refinement.

SUMMARY OF THE DISCLOSURE

The present invention introduces such refinement. The invention has different facets or aspects, which can be practiced independently—but which, to optimize and enhance the benefits of the invention, are preferably used in combination together.

In preferred embodiments of a first of these aspects, the present invention is apparatus for printing images by marking with a liquid-base ink on a web-form printing medium that has a longitudinal direction and two lateral edges. The apparatus includes some means for supporting such a medium; for purposes of breadth and generality in expressing the invention, these means will be called the "supporting means".

In this discussion and in certain of the appended claims the term "such" is used in reference to the printing medium to indicate that the medium is not necessarily an element of the invention. Rather for some purposes the medium may be regarded as a part of the operating environment, or context, of the invention.

Preferred embodiments of the first aspect of the invention also include a marking head disposed for marking on such medium—and also some means for engaging such medium and for advancing such medium longitudinally past the marking head. These latter means, again for generality and breadth, will be called the "engaging-and-advancing means".

Also included are first guide means for restraining such medium. The first guide means perform such restraint over an area that is:

upstream, longitudinally, from the marking head, and extended laterally across substantially a full width of such medium except in one or more regions that are laterally near the engagement of the engaging-and-advancing means with such medium.

(The phrase "that are laterally near" is used herein to convey that certain elements are relatively close together when taking into account only components of distance in the lateral direction—that is to say, the direction transverse to the direction of printing-medium advance. Thus those elements may be relatively far apart along the direction of printing-medium advance, but may still satisfy the condition that they are laterally near.)

Preferred embodiments of the invention, still with respect to its first facet, also include second guide means for restraining such medium, over an area that is:

disposed laterally from the marking head, and extended laterally across such medium only in one or more regions that are laterally near the engagement of the engaging-and-advancing means with such medium.

The foregoing may constitute a definition or description of the first facet or aspect of the invention in its broadest or most general form. It can be seen, however, that even in this form this first aspect of the invention resolves problems with which the prior art did not deal optimally.

In particular, because the first guide means do not interfere with the engaging-and-advancing means, the engaging-and-advancing means can be placed immediately upstream of the print zone, rather than being necessarily offset from it along the advance path by 3½ centimeters (1½ inches) or more as are the drive roller and pinch wheel of the prior system discussed above. This alone very advantageously decreases the height of the end-of-page zone; and as will be seen other dimensional refinements are possible to decrease that height still further.

In addition, because the second guide means are generally in the same region, laterally, as the engaging-and-advancing means—and most typically therefore in the same region laterally as a tensioning system, which is advantageously included—the second guide means very effectively prevent the medium from curling upward to strike tensioning-system components (as for example the medium strikes the pen or star wheels in the above-discussed prior system)—or the pen.

Although the invention thus provides very significant advances relative to the prior art, nevertheless for greatest enjoyment of the benefits of the invention it is preferably practiced in conjunction with certain other features or characteristics which enhance its benefits.

For example, it is preferred that the engaging-and-advancing means in fact engage such medium only near the lateral edges of such medium; and that the first guide means restrain such medium over an area that is extended laterally across substantially a full width of such printing medium except near the lateral edges of such medium. More specifically, it is even more highly preferable that the first guide means restrain such medium over an area that is extended laterally across the width of such printing medium except for a strip, about one and a half centimeter wide, along each lateral edge.

Again as the first guide means do not extend fully to the lateral edges of the printing medium, if the drive roller and pinch wheel are positioned near those edges they can be longitudinally very near the print zone. Despite this proximity they can also be kept near the lateral edges of the medium where any surface disturbance which they may produce (e.g., impressions from a pinch wheel) can be clear of the image area.

Furthermore, placement of the second guide means along the lateral edges of the medium, just outside the print zone to left and right, very effectively prevents those edges from curling upward to erratically vary the ink-drop flight distance—as well as to strike tensioning-system components or the pen, per the more general case already discussed. This improved control thus significantly improves image quality as well as the reliability of printing-medium advance.

It is further preferable that the second guide means be bifurcated, disposed laterally in two directions from the marking head, and extended laterally across only the lateral edges of such medium—to hold such medium at its lateral edges. Again more specifically, the second guide means preferably are extended laterally across a strip, a few millimeters wide, along each lateral edge. Ideally the strip along each lateral edge, respectively, is approximately three millimeters wide.

Preferably the apparatus also includes a human-actuable control for selecting a printing-medium width from a plurality of widths accommodated by the apparatus; and some means responsive to the control for laterally shifting at least one of the bifurcations of the second guide means. This feature is particularly desirable in a bifurcated-second-guide-means system, with the second guide means disposed along the edges of the printing medium—to retain the ability of earlier systems to handle printing-medium sheets of more than one width.

In addition the apparatus preferably includes some means, longitudinally beyond the marking head from the advancing-and-engaging means and generally aligned laterally with the advancing-and-engaging means, for tensioning such medium away from the advancing-and-engaging means. These tensioning means hold such medium substantially taut at the marking head.

Preferably too the marking head operates in a print zone; the advancing-and-engaging means are very closely spaced upstream from the print zone; and the tensioning means are very closely spaced downstream from the print zone. As will be seen this characteristic can be promoted by advantageous design and dimensioning of the advancing-and-engaging means and the tensioning means.

In preferred embodiments of another of its facets, the invention is a method of printing desired images on a printing medium by construction from individual marks formed in pixel arrays by a scanning print head that operates in conjunction with a printing-medium advance mechanism. This method includes repetitively scanning the print head across the printing medium. It also includes periodically, between repetitions of scanning the print head across the printing medium, advancing the printing medium stepwise, by a normal distance at each step.

The method further includes—generally during the above-mentioned scanning and operating—tensioning such medium between an advance wheel and a tensioning wheel; and determining when a trailing edge of such printing medium passes a first of the advance and tensioning wheels so that such printing medium is no longer tensioned.

The method also includes responding to the determining step by decreasing the distance of advance through the apparatus, at each step, while such printing medium is no longer tensioned.

The foregoing may be a description or definition of the present invention in its broadest or most general terms. Even in such general or broad forms, however, as can now be seen the invention resolves the previously outlined problems of the prior art.

In particular the use of a smaller advance distance in the end-of-page region decreases the undesirable accumulation of positioning error at each step of the mechanism. This decrease correspondingly diminishes the inaccuracy that is available, at each step, to contribute to the objectionable banding described earlier.

Although the second facet of the invention thus provides very significant advances relative to the prior art, nevertheless for greatest enjoyment of the benefits of the invention it is preferably practiced in conjunction with certain other features or characteristics.

For example, as previously mentioned it is preferred that the second facet of the invention be practiced in combination together with the first. It is also preferred that the aforementioned "decreasing" include reducing the distance of advance, in each step, to about half the normal distance.

More specifically, it is preferred that the normal distance of advance be approximately thirty-two pixel rows at each step; and that the "decreasing" include reducing the distance of advance to approximately sixteen pixel rows.

All of the foregoing operational principles and advantages of the present invention will be more fully appreciated upon consideration of the following detailed description, with reference to the appended drawings, of which:

BRIEF DESCRIPTION OF THE DRAWINGS

FIG. 1 is a generally diagrammatic side elevation of a preferred embodiment of the invention and particularly its above-introduced first facet or aspect;

FIG. 2 is a generally diagrammatic plan view of the FIG. 1 embodiment;

FIG. 3 is a more mechanically pictorial perspective view of the same embodiment;

FIG. 4 is an elevation analogous to FIG. 1—but representing the prior-art system discussed earlier in this document;

FIG. 5 is a plan view analogous to FIG. 2, but representing the FIG. 4 prior-art system;

FIG. 6 is a perspective view of a so-called "star wheel" that is, as mentioned earlier, preferred for use in the present invention.

Figure 7:
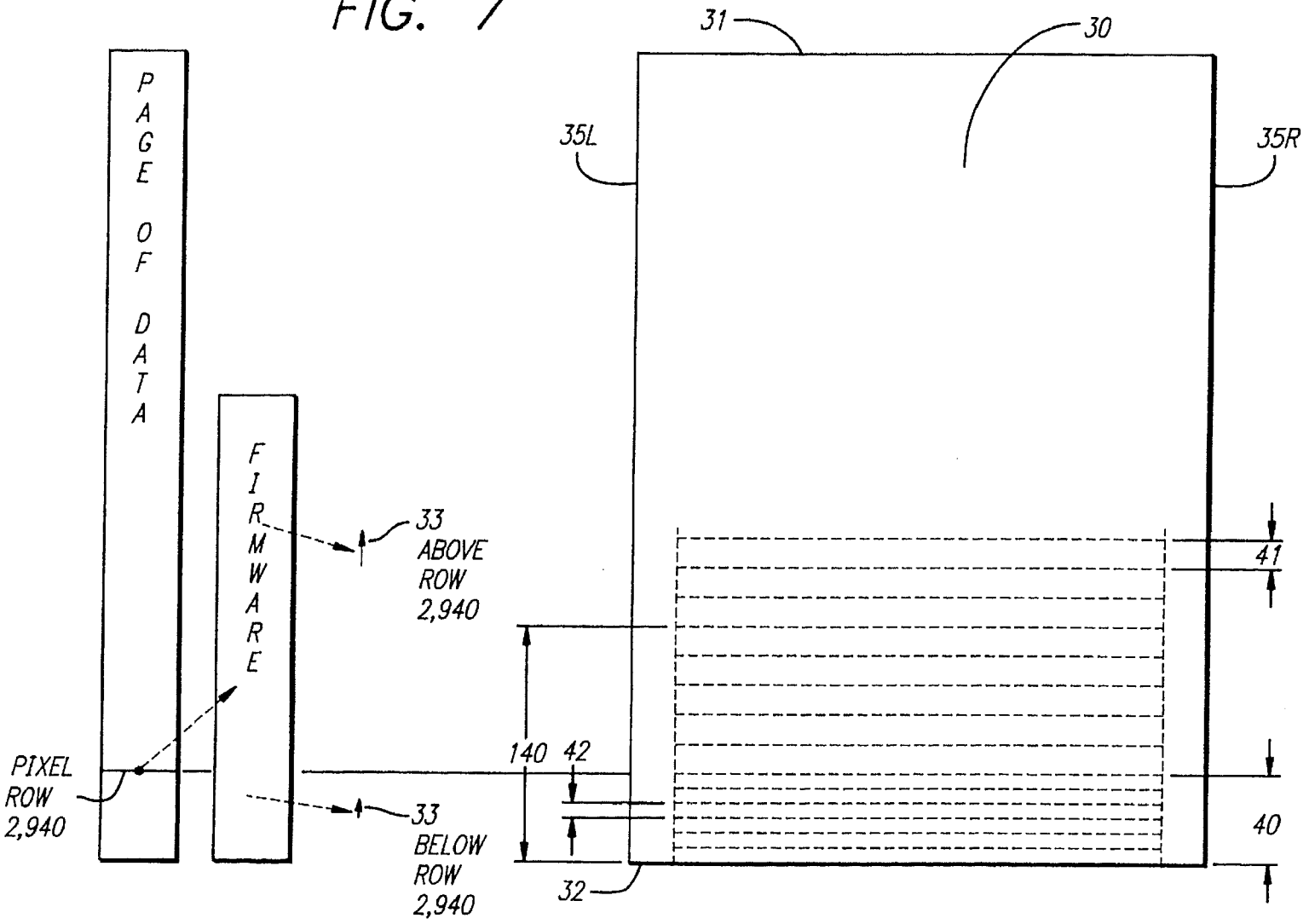
FIG. 7 is a diagram comparing end-of-page regions and advance distances for preferred embodiments of the invention vis-a-vis a typical prior-art system, and including a block-diagrammatic showing of the data, firmware and print-medium-advance control relative to a printed page.

The drawings are not to scale.

DETAILED DESCRIPTION OF THE PREFERRED EMBODIMENTS

FIGS. 1 and 2 show that in preferred embodiments of the invention the guide means take the form of three discrete plates 21, 23L, 23R for controlling out-of-plane deformation of a printing medium 30, such as paper, as the medium passes in one direction 33 longitudinally through the mechanism. In principle the three elements 21, 23L, 23R might perhaps be consolidated into one or two shaped plates.

One of the three, a generally central plate 21, is positioned with its forward edge 22 just short of the input or upstream edge of the print zone 34—which is to say, the operating zone of the nozzles 11 of a pen 10. The lateral edges 29 of the central plate 21 are spaced inboard, by a distance 36 (preferably 1½ cm), from the left and right edges 35R, 35L of the narrowest medium 30 to be accommodated in the machine.

To both sides of the central plate 21, operating on vertically common centerlines 24C, 25C, are drive wheels 25 and pinch rollers 24. At one side (for instance the left side) these may be, as preferred, either extended or shiftable laterally to accommodate wider print-media stock.

The other two plates are respectively left- and right-side guides 23L, 23R, disposed laterally to left and right, respectively, from the print zone 34. The inboard edge of each side guide 23L, 23R is spaced inboard, by a distance 37 (preferably 3 mm), from the lateral edges 35L, 35R of the medium respectively.

Preferably at least one 23L of these side guides is shiftable laterally—as, for instance, to a further-outboard position 23L', similarly disposed with a 3 mm overlap relative to the left edge 35L' of wider print-media stock—to accommodate such wider stock. The shifting may be controlled automatically, as in response to the width of print media loaded into the machine, or as FIG. 3 shows may be operator actuated in accordance with a selected print-medium width.

The plates 21, 23L, 23R hold the printing medium 30 against a preferably heated flat backup or support surface 20 (although certain of the other elements also function to support the medium 30). This consistent flat orientation helps to provide good print quality.

Tensioning rollers 27 and star wheels 26 are positioned on vertically common centers 26C, 27C just past the output or downstream edge of the print zone 34. These elements pull the print medium 30 taut relative to the drive rollers 24 and pinch wheels 25, as long as the trailing edge 32 of the medium 30 has not yet passed through those rollers and wheels 24, 25.

After the trailing edge 32 of the medium 30 has passed those elements 24, 25, the tensioning rollers 27 and star wheels 26 continue to pull the medium 30 through the print zone 34, to complete printout of the desired image on the sheet 30. The centerlines of the two sets of rollers 26C/27C, 24C/25C are separated by a distance 28 (preferably three centimeters, roughly 1.2 inch) that is less than four times the longitudinal dimension 34' (most typically about eight millimeters, about 0.32 inch) of a single-pen print zone 34.

Although for simplicity of the drawings just one pen 10 is shown explicitly, we mean it to represent the four pens in a typical color-plus-black inkjet printer. Hence it will be understood that the above-mentioned distance 28—as contrasted with the analogous distance 128 in the prior-art system discussed earlier—very closely encompasses the full print-zone dimension for all four pens. The distance 28 is just great enough to allow all the pens to scan back and forth across the sheet and print, without mutual interference of their respective printed swaths—and without striking the pinch or star wheels.

To facilitate providing this relatively close relationship, the upper wheels 24, 26 and lower rollers 25, 27 are all of smaller diameter (9, 8.8, 18 and 8.4 mm respectively) than the most-nearly analogous elements of the prior apparatus discussed above. Thus the present invention proceeds in part from a recognition that the prior-art system discussed earlier suffered from an excessively long span of printing medium between the drive and tension rollers—at three distinct times during printing of a sheet of medium:

near the head of the sheet, before a leading edge is captured by the tensioning rollers and star wheels, when curling out of plane leads the print medium to strike the star wheels too high and cause a paper jam;

during printing near the center of the medium, where out-of-plane edge curling at midspan is not controlled ideally for best image quality, and also in particular while that span is unconstrained at the bottom of the page. These problem areas, and hence the improvements provided by the present invention, are all particularly important in view of the use of heating to promote drying. It has already been mentioned that application of heat accentuates deformation out of plane.

As a result of improved dimensioning in accordance with the present invention, the height 40 (FIG. 7) of the end-of-page zone—in which only one set of elements can control the trailing edge 32 of the medium 30—is reduced by a factor of about 2½ (relative to the prior-art zone height 140). This reduction greatly diminishes the objectionable conspicuousness of any banding in that zone.

Furthermore, the distance by which the printing medium advances, even within the shallower end-of-page zone, is reduced by about half—from the standard distance 41 employed above the end-of-page zone (and in the prior art employed over the entire length of the sheet 30) to the special shorter distance 42. The standard distance 41 is preferably the height of thirty-two pixel rows (about one-ninth inch), and the special shorter distance 42 preferably the height of only sixteen rows (one-nineteenth inch).

In general the advance by only one-nineteenth inch helps hide medium-advance errors within the end-of-page zone. Many images, however, actually terminate about two or three centimeters from the bottom edge of the page; for images that happen to end within the first nineteenth inch at the upper end of the bottom-of-page zone, actually there is no medium-advance error to hide. It is preferred to use three passes for both segments of the page.

When media of different widths are loaded into the machine, it is advantageous to shift one or both of the side guides 23L, 23R to maintain the restraints immediately at the edges of the media as diagrammed in FIG. 2. As shown in FIG. 3, a system for performing this function semiautomatically preferably includes a lateral stop 51 for aligning in common one edge of a multiplicity of sheets 30 in a stack 30" of printing-medium sheets.

The system also includes a user-actuable device 52 for selecting printing-medium width—and in particular shifting the stop 51 laterally. A mechanism 53 transmits the user's manual selection to shift the adjacent (here the left-side) hold-down guide 23L as well.

The adjacent guide 23L is thus semiautomatically adjusted for position next to the print zone when the sheets of printing medium are loaded into the printing machine. This arrangement avoids the necessity of adjusting the guide 23L separately. (As mentioned earlier, adjustment of the guide 23L, as well as the stop 51, could be fully automated in response to the width of the stack 30" of printing-medium sheets.)

The guide system shown in FIGS. 1 through 3—and particularly the side hold-down pair 23L, 23R—restrains print media in and near the print zone so that the printing mechanism does not contact the media during printing or media advancing. Ink smearing, and tearing and folding of the media, are thereby substantially prevented. Top and bottom margin requirements are nevertheless minimal.

In addition the invention substantially prevents print-quality degradation at the bottom of the page—when the tension roller becomes the primary paper driver—without introducing a large tension roller that would force the interroller span to undesirably large values. To put it the other way around, a small tension roller, and therefore short span between rollers, can be used to obtain best print quality near the top of the page and near the center of the page, without sacrificing print quality near the end.

These improvements are accomplished by firmware detection of data ready for printout in the region 40 (FIG. 7) near the bottom of the page, namely below approximately pixel row 2,940—warning of page advance by only the tension roller, and at that point resetting the number of pixel rows of advance 33 at each step from thirty-two rows, i.e. the height 41, to sixteen rows, i.e. the height 42. In this way only half the positional error arising from tension-roller tolerances is accrued—and relieved—at each step.

It will be understood that the foregoing disclosure is intended to be merely exemplary, and not to limit the scope of the invention—which is to be determined by reference to the appended claims.

What is claimed is:

1. Apparatus for printing images, by marking with a liquid-base ink, on a web-form printing medium that has a longitudinal direction and two lateral edges; said apparatus comprising:

means for supporting such medium;

a marking head disposed for marking on such medium;

means for engaging such medium and for advancing such medium longitudinally past the marking head;

first guide means for restraining such medium, over an area that is:

upstream, longitudinally, from the marking head, and extended laterally across substantially a full width of such medium except in one or more regions that are laterally aligned with, or laterally immediately adjacent to, the engagement of the engaging-and-advancing means with such medium;

wherein the first guide means do not engage such medium in any region that is laterally aligned with, or laterally immediately adjacent to, the engagement of the engaging-and-advancing means with such medium; and second guide means for contacting and restraining such medium, over an area that is:

disposed laterally from the marking head, and extended laterally across such medium only in one or more regions that are laterally aligned with, or laterally immediately adjacent to, the engagement of the engaging-and-advancing means with such medium.

2. The apparatus of claim 1, wherein:

the engaging-and-advancing means engage such medium only at or immediately adjacent to the lateral edges of such medium; and the first guide means restrain such medium over an area that is extended laterally across substantially a full width of such printing medium except at and immediately adjacent to the lateral edges of such medium.

3. The apparatus of claim 2, wherein:

the first guide means restrain such medium over an area that is extended laterally across the width of such printing medium except for a strip, about one and a half centimeter wide, along each lateral edge.

4. The apparatus of claim 2, wherein the second guide means are:

bifurcated;

disposed laterally in two directions from the marking head; and extended laterally across only the lateral edges of such medium, to hold such medium at its lateral edges.

5. The apparatus of claim 4, wherein:

the second guide means are extended laterally across a strip, a few millimeters wide, along each lateral edge respectively.

6. The apparatus of claim 5, wherein:

the strip along each lateral edge, respectively, is approximately three millimeters wide.

7. The apparatus of claim 4 further comprising:

a human-actuable control for selecting a printing-medium width from a plurality of widths accommodated by the apparatus; and means responsive to the control for laterally shifting at least one of the bifurcations of the second guide means.

8. The apparatus of claim 2, further comprising:

means, longitudinally beyond the marking head from the advancing-and-engaging means and generally aligned laterally with the advancing-and-engaging means, for holding such medium in substantially a planar configuration without wrapping around any wheel or the like, and for tensioning such medium away from the advancing-and-engaging means to hold such medium substantially taut at the marking head.

9. The apparatus of claim 1, further comprising:

means, longitudinally beyond the marking head from the advancing-and-engaging means and generally aligned laterally with the advancing-and-engaging means, for holding such medium in substantially a planar configuration without wrapping around any wheel or the like, and for tensioning such medium away from the advancing-and-engaging means to hold such medium substantially taut at the marking head.

10. The apparatus of claim 9, wherein:

the marking head operates in a print zone;

the advancing-and-engaging means are very closely spaced upstream from the print zone; and the tensioning means are very closely spaced downstream from the print zone;

wherein said very close spacing minimizes deformable length of the printing medium between the advancing-and-engaging means and the tensioning means; and wherein said planar configuration, without wrapping, enables both:

said very close spacing of the advancing-and-engaging means and said minimization of deformable length of the printing medium between the advancing-and-engaging means and the tensioning means.

11. The apparatus of claim 10, wherein:

the advancing-and-engaging means comprise a first wheel that engages the marking surface of such medium and a second wheel that engages the opposite surface of such medium;

tensioning means comprise a third wheel that engages the marking surface of such medium and a fourth wheel that engages the opposite surface of such medium.

12. The apparatus of claim 11, wherein:

the distance between the centers of the first and third wheels is approximately 13 millimeters greater than the sum of (1) the radius of the first wheel, (2) the radius of the third wheel, and (3) the longitudinal dimension of the print zone.

13. The apparatus of claim 11, wherein:

the sum of the radii of the first and third wheels and the longitudinal dimension of the print zone is approximately 18 millimeters; and the first and third wheels are centered approximately thirty millimeters apart.

14. Apparatus for printing images, by marking with a liquid-base ink, on a web-form printing medium that has two surfaces and two lateral edges; said apparatus comprising:

a marking head disposed for marking on a first surface of such medium;

backup means for restraining a second surface of such medium at a maximum distance from the marking head;

means for engaging such medium and for advancing such medium along the backup means in an advance direction and past the marking head;

means, disposed beyond the marking head from the advancing means, for tensioning such medium away from the advancing means to hold such medium substantially taut at the marking head;

first guide means for restraining the first surface of such medium, to hold such medium against the backup means; said first guide means being adjacent to the backup means over an area of the backup means that is:

upstream, with respect to the advance direction, from the marking head, and extended laterally across substantially a full width of the backup means except at lateral edges of the backup means, to hold such printing medium against the backup means across the lateral extent of the backup means except at the edges;

wherein the first guide means do not extend to the lateral edges of the backup means, and do not hold such printing medium against the backup means at the edges;

second guide means for restraining the first surface of such medium, to hold such medium against the backup means; said second guide means being adjacent to the backup means over an area of the backup means that is:

laterally disposed, with respect to the advance direction, in both directions from the marking head, and extended laterally across only edges of the backup means to hold edges of the printing medium against the edges of the backup means.

* * * * *